US006042214A

United States Patent [19]

Minowa et al.

[11] Patent Number: 6,042,214

[45] Date of Patent: Mar. 28, 2000

[54] INK JET PRINTER AND CONTROL METHOD THEREFOR

[75] Inventors: Masahiro Minowa; Chiyoshige Nakazawa, both of Suwa, Japan

[73] Assignee: Seiko Epson Corporation, Tokyo, Japan

[21] Appl. No.: 08/841,421

[22] Filed: Apr. 22, 1997

[30] Foreign Application Priority Data

Apr. 23, 1996 [JP] Japan ..... 8-101746
Apr. 23, 1996 [JP] Japan ..... 8-101747

[51] Int. Cl.[7] ..... B41J 2/165

[52] U.S. Cl. ..... 347/23; 347/35

[58] Field of Search ..... 347/23, 35, 22, 347/14

[56] References Cited

U.S. PATENT DOCUMENTS

| | | | |
|---|---|---|---|
| 5,252,993 | 10/1993 | Tomii et al. | 347/32 |
| 5,341,163 | 8/1994 | Hanabusa | 347/23 |
| 5,572,242 | 11/1996 | Fujii et al. | 347/23 |
| 5,583,547 | 12/1996 | Gast et al. | 347/22 |

FOREIGN PATENT DOCUMENTS

| | | |
|---|---|---|
| 0 435 694 | 7/1991 | European Pat. Off. . |
| 0 442 438 | 8/1991 | European Pat. Off. . |
| 0 559 122 | 9/1993 | European Pat. Off. . |
| 0 674 996 | 10/1995 | European Pat. Off. . |
| 0 694 404 | 1/1996 | European Pat. Off. . |
| 61-230942 | 10/1986 | Japan . |
| 61-249759 | 11/1986 | Japan . |
| 1-281950 | 11/1989 | Japan . |
| 4-255361 | 9/1992 | Japan . |

*Primary Examiner*—N. Le
*Assistant Examiner*—Shih-wen Hsieh
*Attorney, Agent, or Firm*—Mark P. Watson

[57] ABSTRACT

An ink jet printer and control method therefor efficiently eliminates temporary ink eject defects during print interruptions. A time interval, i.e., the time lapse between a previous ink ejecting operation and a present ink ejecting operation, is evaluated before printing. If the time interval is less than a first time reference value (t1), an ink purging operation is not performed or is performed only a first minimum number of times. If the time interval is between first and second time reference values ($t1 \leqq TI < t2$), ink purging is executed a second number of times. If the time interval is greater than or equal to the second time reference value ($t2 \leqq TI$), ink purging is executed a third number of times that is less than the specified second number of times.

9 Claims, 5 Drawing Sheets

INK JET PRINTER AND CONTROL METHOD THEREFOR

BACKGROUND OF THE INVENTION

1. Field of the Invention

The invention relates to an ink jet printer, and relates particularly to an ink jet printer that executes a nozzle purging or refresh operation to prevent nozzle clogging.

2. Description of the Related Art

Various control means and methods have been proposed to prevent ink clogging inside the nozzles of ink jet printers that print by ejecting ink from such nozzles. These various control means and methods include defining a particular number of nozzle purging operations to clear the nozzles based on the elapsed time of continuous no-printing of the ink jet head. One such method is described in Japanese patent laid-open number 1-281950 (1989-281950), and also in U.S. Pat. No. 5,572,242, which is commonly assigned and has a common inventor with the present application.

The conventional ink jet printers described above use methods whereby the number of nozzle purging occurrences increases in proportion to the down time (no-ejection time) of the ink jet head. This method does not, however, consider ink characteristics, and therefore does not ensure the optimal ink purging volume for a particular ink type. This results in wasteful ink consumption and printing without sufficient ink purging or complete nozzle refreshing, which can cause printing defects.

OBJECTS OF THE INVENTION

Therefore, it is an object of the present invention to overcome the aforementioned problems.

An object of the present invention is to reduce ink consumption and prevent deficient ink ejecting during printing, and to stabilize printing after a period of printer non-use by efficiently purging high viscosity or high density residual ink in the ink jet head nozzles to prevent problems in the printing process.

SUMMARY OF THE INVENTION

To accomplish the above objects, an ink jet printer according to the present invention comprises plural nozzles for ejecting ink droplets, executes an ink purging operation to prevent nozzle clogging when a no-ejection state continues for a particular time, and comprises a counter, storage means, and a nozzle refreshing means for such purging operations.

Specifically, the counter counts or measures a particular time interval, which is the time between the last ink ejection or purge from the nozzles and the present ink ejecting operation. The storage means stores at least two time reference values, a first time reference value and a second time reference value that is longer than the first time reference value, which are used for comparison with the time interval measured by the counter.

Before printing starts, the nozzle refreshing means compares the measured time interval with two time reference values before printing. If the measured time interval is less than the first time reference value, the nozzle refreshing means executes an ink purging operation a first predetermined number of times that is greater than or equal to zero; if the time interval is between the first time reference value and the second time reference value, the ink purging operation is executed a second predetermined number of times; and if the time interval is greater than the second time reference time value, the ink purging operation is executed a third predetermined number of times that is less than the second number of times.

The control method of the present invention for an ink jet printer comprising plural nozzles for ejecting ink droplets executes an ink purging operation to prevent nozzle clogging when a no-ejection state continues for a particular time in accordance with the following process.

The control method counts or measures the time interval between the last ink ejection or purge from the nozzles and the present ink ejecting operation, and, before printing, compares the measured interval with at least two predefined time reference values, a first time reference value and a second time reference value that is longer than the first time reference value. If the measured time interval is less than the first time reference value, an ink purging operation is executed a first predetermined number of times that is greater than or equal to zero. If the measured time interval is between the first time reference value and the second time reference value, the ink purging operation is executed a second predetermined number of times. If the measured time interval is greater than the second time reference value, the ink purging operation is executed a third predetermined number of times that is less than the second number of times.

The ink jet printer and control method therefor of the present invention accomplishes a nozzle refreshing process optimized for specific ink characteristics. The time reference values and number of purging operations are selected on the basis of empirical data for a particular printer type and ink type. Consumption of excessive ink during the nozzle refreshing process is thus suppressed, and a nozzle clogging prevention or refreshing process can be accomplished with particular efficiency.

In addition, wasteful ink consumption can be further minimized by starting the measurement of the time interval from the previous ink purging operation, counting the ejecting count for each nozzle during printing, continuing the measurement during printing if even one of the plural nozzles does not eject for at least a particular preset count, and resetting the measured time interval and restarting the measurement of the time interval time only when the ejecting count of every nozzle has reached the particular preset count.

Furthermore, the time reference values are not limited to just two time reference values, and more than two time reference values can be used. For example, by providing in addition to the first and second time reference values a third reference time value that is longer than the second time reference value, the nozzle refreshing means can execute the ink purging operation a fourth predetermined number of times greater than the third number of times when the measured time interval is greater than or equal to the third time reference value.

Moreover, if the ink jet printer comprises a cap for covering the nozzles, the nozzles can be covered with a cap when the measured time interval since the last ink ejecting or purging operation is greater than or equal to the second time reference value, and measurement of the time interval can be interrupted after the nozzles are capped.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, wherein like reference symbols refer to like parts.

DESCRIPTION OF THE PREFERRED EMBODIMENTS

A preferred embodiment of an ink jet printer according to the present invention is described below with reference to the accompanying figures.

Figure 4:
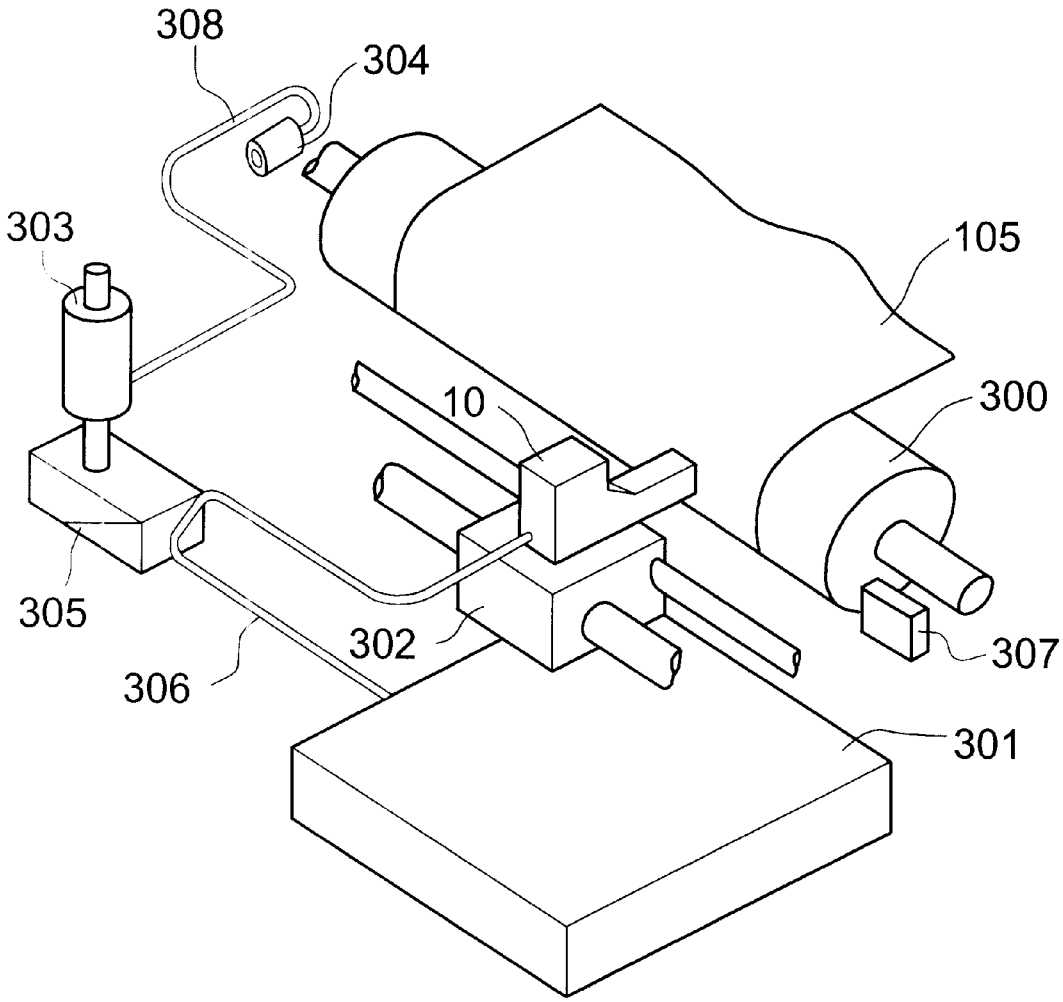
FIG. 4 is a simplified illustration of an ink jet printer.

FIG. 4 is a simplified illustration of a serial ink jet printer comprising an on-demand type ink jet head.

Referring to FIG. 4, ink is supplied to ink jet head 10 by means of ink tube 306 carrying ink from ink tank 301. A cap 304 covers the nozzle surface and recovers waste ink ejected from ink jet head 10 during the ink purging operation in which the ink jet head 10 is first moved to a position in front of cap 304. The waste ink is pumped by pump 303 from cap 304 through waste ink recovery tube 308 to the recovered ink tank 305.

Also shown are the platen 300, carriage 302 on which the ink jet head 10 is mounted, and recording medium 105.

Note that recovered ink tank 305 is not always necessary and can be replaced by a piece of felt or other ink absorbing member to absorb the waste ink. In such case the waste ink recovery tube 308 can also be eliminated.

The ink jet head 10 is an on-demand type head comprising plural nozzles for ejecting ink, an ink path to each of the nozzles, a vibrator disposed in some part of each ink path, and plural actuators for driving each of the vibrators. Current is supplied selectively to the actuators based on the print data to eject ink from the corresponding nozzle.

Ink jet head 10 is transported in the direction perpendicular to the direction of recording medium transportation, which is synchronized to the movement of the ink jet head 10 for printing. The printing operation is executed line by line. This produces a time interval in which no recording (ink ejecting) is performed while the recording medium 105 is advanced to the next line.

Figure 1:
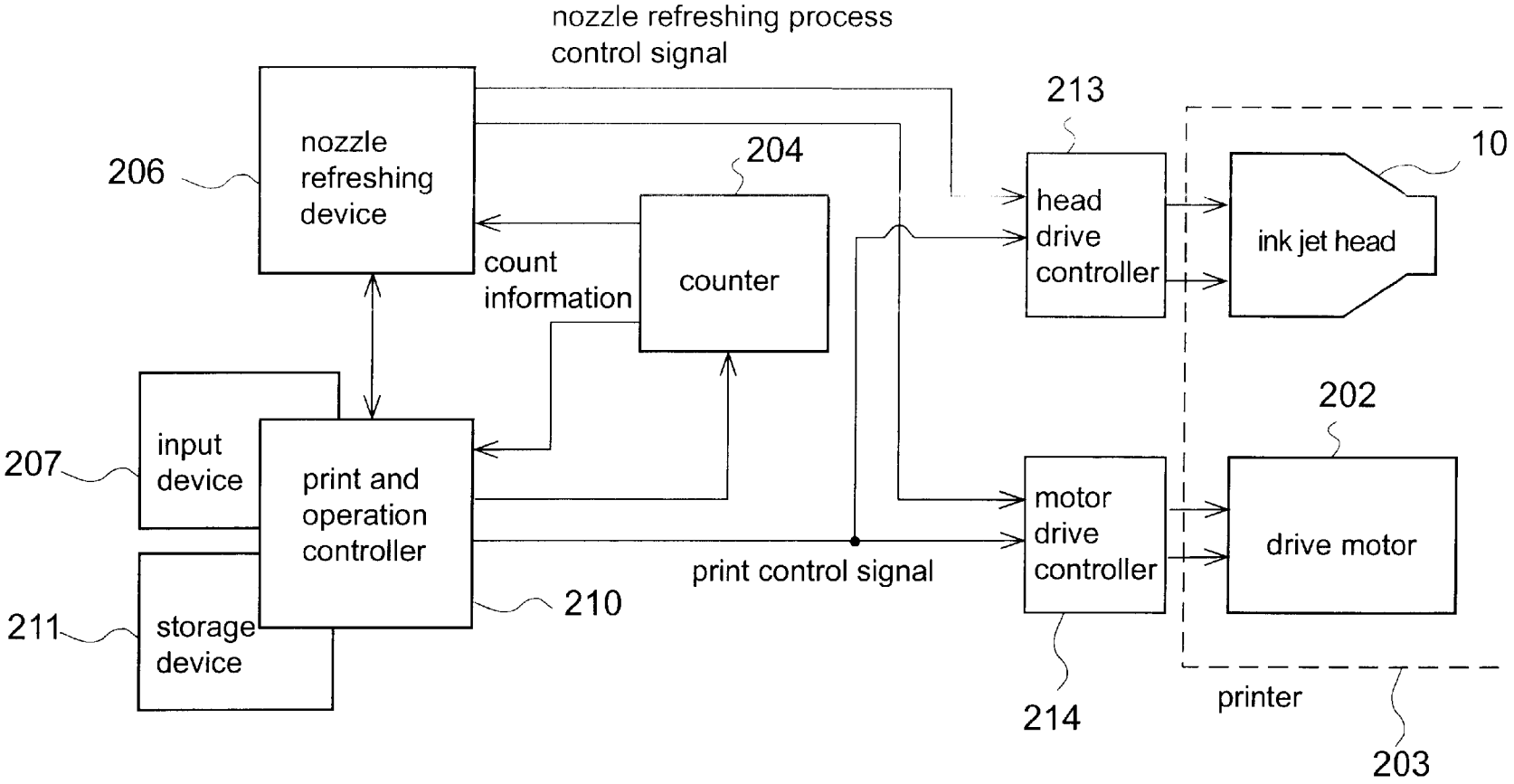
FIG. 1 is a block diagram of the drive control apparatus of an ink jet printer according a preferred embodiment of the invention.

FIG. 1 is a block diagram of the drive control apparatus of an ink jet printer according to a preferred embodiment of the invention. Referring to FIG. 1, drive motor 202 is used to move the ink jet head 10, advance the paper or other recording medium 105, and cover or uncover the nozzles with the cap 304. The printer 203 comprises primarily ink jet head 10 and drive motor 202. This printer 203 prints text and images by ejecting ink droplets from ink jet head 10 to the recording medium 105 while moving ink jet head 10 and recording medium 105 by means of drive motor 202.

Also shown in FIG. 1 are counter 204 for measuring the non-printing time, a nozzle refreshing device 206, input device 207, print and operation controller 210, storage device 211, head drive controller 213, and motor drive controller 214. Counter 204 also counts ejections from each individual nozzle during printing and compares such ejection counts to a preset count to determine if each nozzle has ejected a sufficient number of times during a printing operation.

Nozzle refreshing device 206 controls a refreshing process for preventing nozzle clogging or increased ink viscosity or for recovering ink. Information such as the print data is input through input device 207 to print and operation controller 210, which controls printing and other operations using the input signal from input device 207. More specifically, print and operation controller 210 outputs and controls the initialization signal for activating counter 204, the print control signal controlling printer 203, and other control operations.

Storage device 211 stores the data used for the operations processed by print and operation controller 210. The head drive controller 213 controls ink jet head 10 based on the print control signal from the print and operation controller 210 and the nozzle refreshing process control signal from nozzle refreshing device 206, and motor drive controller 214 controls drive motor 202 based on these same signals.

As is well known, the print and operation controller 210 and other process devices can be implemented using a CPU, RAM, ROM, and related peripheral circuit devices, and the counter can be implemented using a timer and/or an incremental counter built into the CPU, for example.

The nozzle refreshing process is described in detail below.

Figure 2:
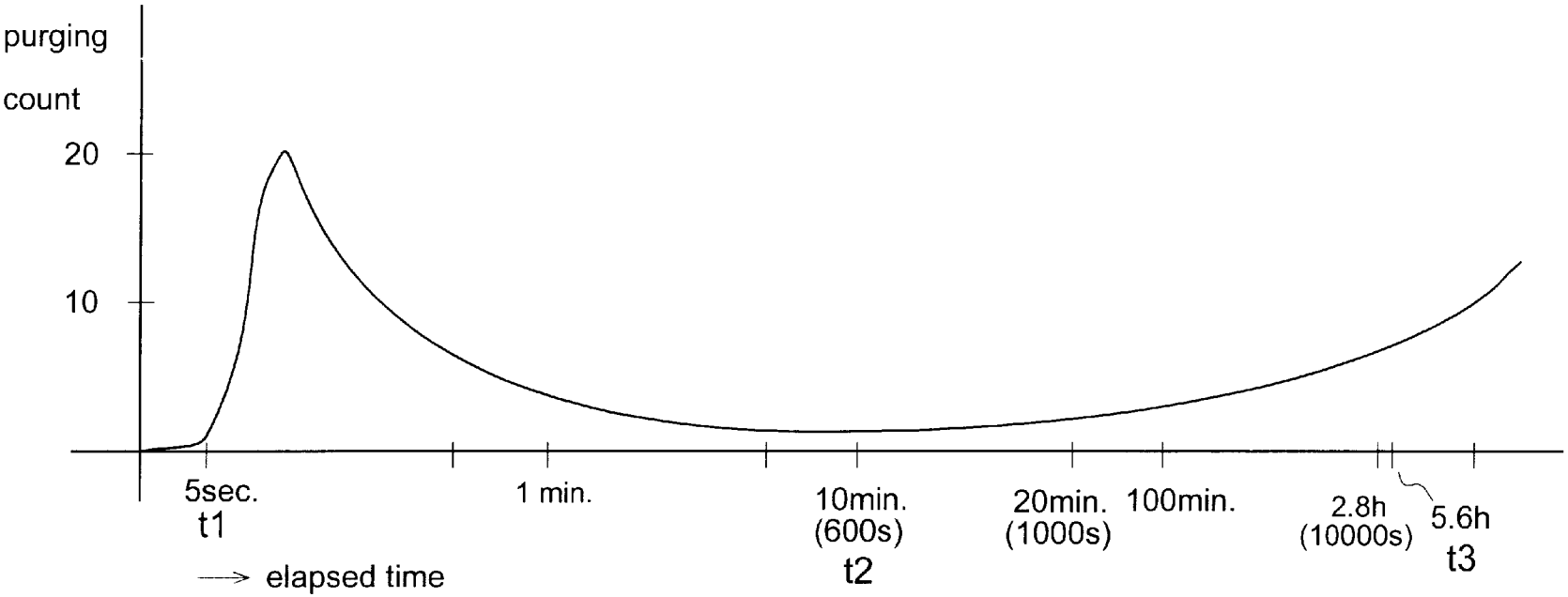
FIG. 2 is a graph showing the relationship between the measured time interval and the optimum number of ink purging operations for preventing nozzle clogging by ink.

FIG. 2 is a graph showing the relationship between the measured time interval from the last to the present ink ejecting operation (axis of abscissas), and the optimum number of ink purging operations (axis of ordinates) required to eliminate ink ejection deficiencies by means of the nozzle refreshing process executed to prevent ink nozzle clogging. More specifically, the graph in FIG. 2 shows the relationship between the ink jet head rest time (no-ejecting time) and the corresponding number of ink purging operations required after a rest before printing starts.

The horizontal axis is marked in logarithmic time scale coordinates where time t1 is approximately 5 seconds, time t2 is approximately 10 minutes, and time t3 is approximately 5 hours. As will be appreciated from this graph, the required number of ink purging operations increases sharply after approximately 5 seconds. This is due to the fact that ink ejecting becomes suddenly more difficult after this period.

While various factors can contribute to this problem, tests using various ink compositions indicate that one such factor is a type of surfactant (surface active agent) used in the ink. More specifically, vibration of the ink causes the surfactant to collect at the nozzle tip after ejecting, thus inhibiting ink ejecting.

Conventional nozzle refreshing processes simply execute a fixed number of preparatory ink purging operations irrespective of the ink jet head rest time based on a peak number of ink purging operations determined in a simple study to prevent clogging and ejecting defects. A detailed study of the optimum number of ink purging operations, however, showed that coagulation of the surfactant is absorbed and dispersed in ink in approximately 7–10 minutes, and ink characteristics are equalized.

More specifically, based on the results of this study shown in the graph in FIG. 2, when the measured time interval exceeds a particular duration, the number of ink purging operations can be reduced to between ½ and ⅓ the peak number required.

The present invention uses this characteristic to great benefit. Specifically, the time durations after which the number of required ink purging operations changes are stored as time reference values in the storage device of the printer. During printing, these time reference values are compared with the time interval measured by the counter to determine which part of the curve in FIG. 2 the measured time interval corresponds. Based on the result of such comparison the ink purging operation is executed an optimum number of times for greatest efficiency.

The control means of the ink jet printer of the present embodiment comprises a counter for measuring the time interval from the last delivery of current to the ink jet head to the present delivery of current; storage device 211 for storing at least two time reference values, a first time reference time value and a second time reference value that is greater than the first time reference value, which values are used for comparison with the time interval measured by the counter; and an evaluation means for determining whether the measured time interval is less than the first time reference time value, is between the first time reference value and the second time reference value, or is greater than the second time reference value. This evaluation means forms part of the print and operation controller 210 and may comprise for example, a CPU, memory, registers and program instructions as will be readily apparent to one having ordinary skill in the pertinent art.

The ink jet printer of the present embodiment further comprises a nozzle refreshing device 206 responsive to the evaluation of the measured time interval before printing. If the measured time interval is less than the first time reference value, nozzle refreshing device 206 executes an ink purging operation a first predetermined number of times that is greater than or equal to zero. If the time interval is between the first time reference value and the second time reference value, nozzle refreshing device 206 executes an ink purging operation a second predetermined number of times. If the time interval is greater than the second time reference value, nozzle refreshing device 206 executes an ink purging operation a third predetermined number of times that is less than the second number of times.

As a result, the refreshing process is accomplished according to specific ink characteristics, such as surfactant type, which characteristics determine the values represented in FIG. 2, for example.

It should be noted that the ink jet printer of the present invention does not necessarily require a cap covering the nozzles. However, when such a cap is provided, a capping controller is included in print and operation controller 210 to move the ink jet head in front of the cap and thereby cap the ink jet head (nozzles) when the ink jet head rest time reaches the second time reference value after printing.

Figure 3:
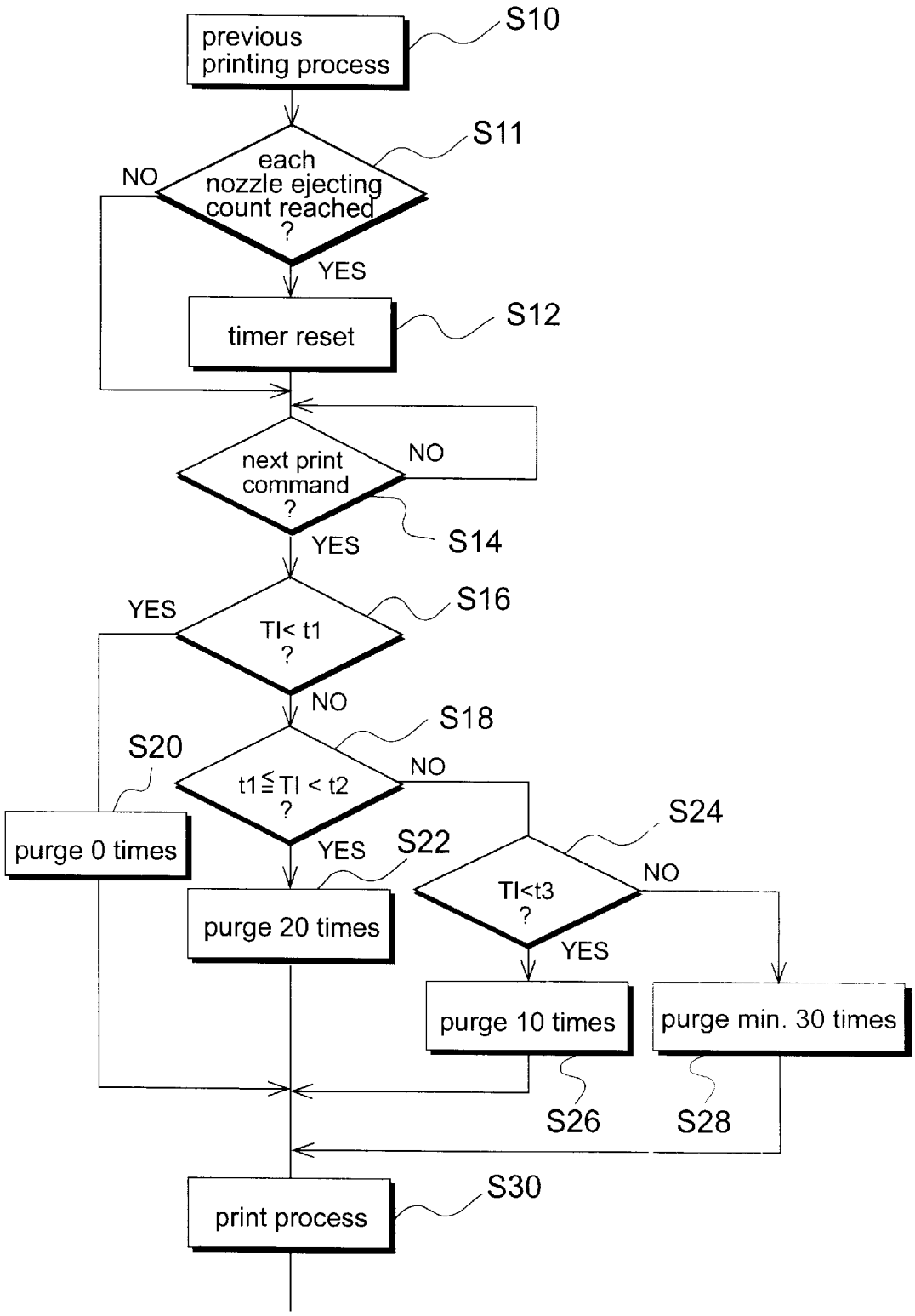
FIG. 3 is a flow chart illustrating the ink jet printer control method according to a preferred embodiment of the invention.

FIG. 3 is a flow chart illustrating the ink jet printer control method according to a preferred embodiment of the invention.

When one printing process (the "previous" process below) is completed (step S10), the timer built into the CPU and used as the counter is reset (step S12) to measure the time interval. However, at step S11 if there is a nozzle that was not used in the previous printing process or was not used for a particular number of ink ejecting operations, the timer is not reset at step S12 and continues counting the time interval from the last time it was reset. The process then waits (step S14) for the next print command. When a print command is issued, a refresh process is executed as follows based on the time interval (TI) value before the printing process is executed. With reference to step S11, and as previously mentioned, counter 204 measures a time interval but is also used to count the number of ejections from each nozzle during printing and compares such counts to a preset count value stored in a register or in the storage device 211. If the ejection count from any nozzle is less than the preset count value then it is considered that the ink jet head has not been fully utilized in that not all nozzles have been used or used sufficiently since the last print operation. The counter 204 therefore continues to measure the time interval from the last complete print operation that sufficiently utilized all nozzles.

If at step S16 the time interval time is less than the first time reference value ($TI<t1$), it is determined that printing is continuing and no ink purging operation is executed (step S20). In this example, the first number of times the nozzle refreshing device 206 executes an ink purging operation is zero.

If the time interval is between first and second time reference values ($t1 \leqq TI<t2$), ink purging is executed a second number of times, i.e., 20 in this example (steps S18, S22).

If the measured time interval is between second and third time reference values ($TI<t3$), ink purging is executed a third number of times, i.e., 10 in this example (steps S24, S26).

If the time interval time is greater than or equal to the third reference time ($t3 \leqq TI$), ink purging is executed a fourth number of times, i.e., 30 in this example (steps S24, S28).

It should be noted that the greater than, less than, and equals comparisons used above do not represent strict mathematical comparisons, but are merely to show relationships between values.

In summary, the present embodiment applies to an on-demand type ink jet printer, and evaluates a particular time interval, i.e., the time lapse between the previous ink ejecting or purging operation and the present ink ejecting command, before printing. If the time interval time is less than a first reference time (t1), an ink purging operation is accomplished 0 times or a first number of times. If the time interval is between first and second time reference values ($t1 \leqq TI<t2$), ink purging is executed a second number of times. If the time interval is greater than or equal to the second reference time ($t2 \leqq TI$), ink purging is executed a predetermined third number of times that is less than the predetermined second number of times.

In step S20 it is sufficient to purge ink zero or a minimum number of times, e.g., 5 times. Times t1, t2, and t3 are time reference values for evaluating the measured time interval, and therefore vary according to the head size, ink composition, and nozzle shape. These values are therefore experimentally determined, set to optimum values, and then stored with the printer control program in a ROM or other storage means. The absolute numbers of ink purging operations are also greatly dependent upon the nozzle type, and the optimum values are therefore determined from, for example, a graph of empirically determined data such as shown in FIG. 2, and then stored in the storage device.

On-demand ink jet printers are also commonly available in two types, one with a cap covering the nozzles, and one without.

The present embodiment can be applied to an ink jet printer having no nozzle cap. Though such ink jet printers may also use a slow drying ink, the ink will still gradually dry and lead to clogging. This tendency can also be seen from the graph in FIG. 2. As a result, the same number of ink purging operations executed when the printer is first turned on is also executed when nothing is printed for an extended period of time, e.g., for 4–5 hours. A third reference time is therefore set for these cases, and when the interval time exceeds this third reference time, ink purging is accomplished a number of times that is greater than the second number of times.

Figure 5:
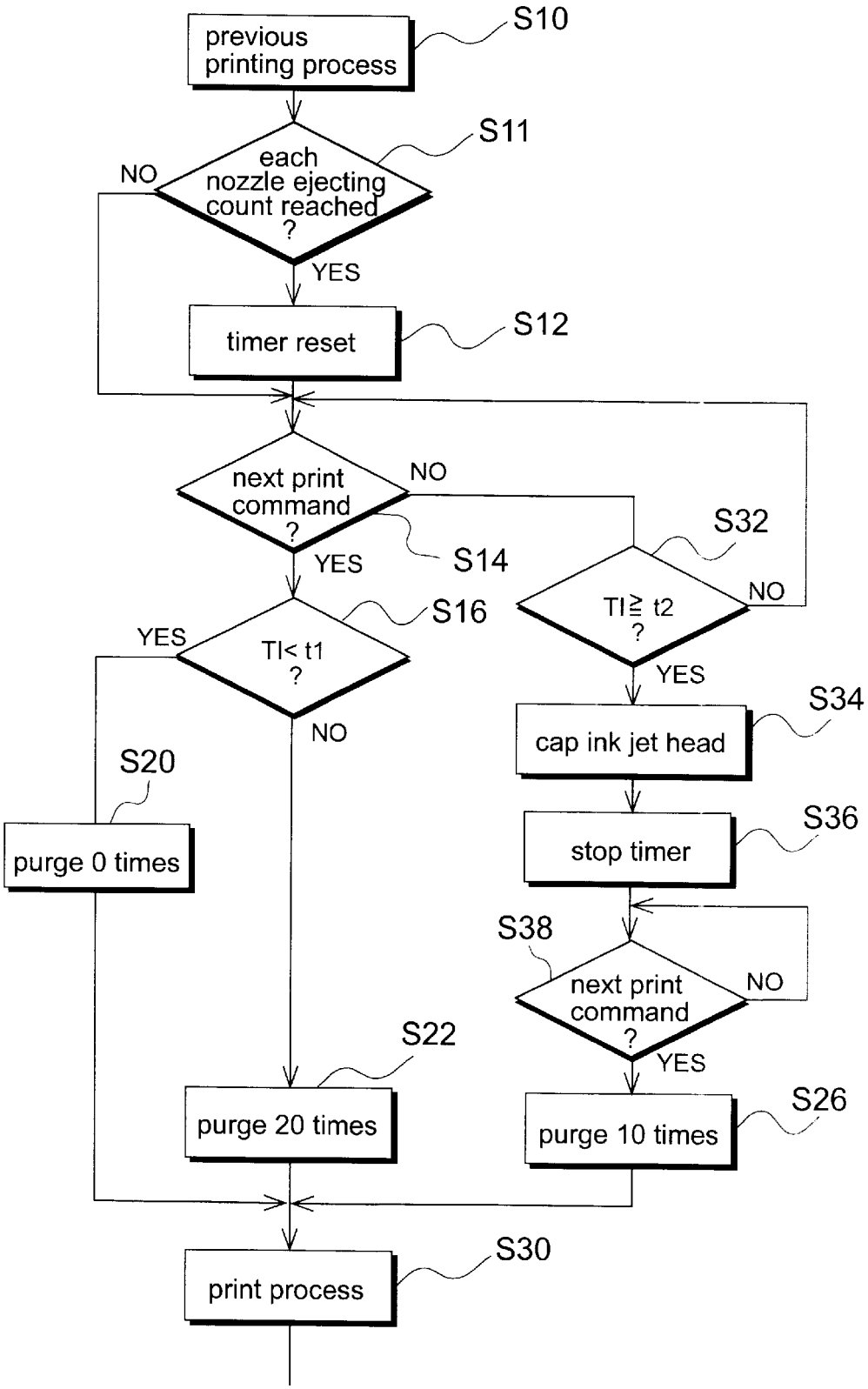
FIG. 5 is a flow chart used to describe the ink jet printer control method according to an alternative embodiment of the invention.

FIG. 5 is a flow chart illustrating the ink jet printer control method according to an alternative embodiment of the invention. Note that like steps are identified by the same step number in FIG. 3 and FIG. 5, and further description thereof is omitted below.

The control process waits at step S14 for the next print command. When a print command is issued, a refresh process is executed (step S16, S20, S22) based on the measured time interval, and the printing process is then executed in step S30 as in the flow chart shown in FIG. 3.

However, if the time interval while standing by for the next print operation becomes greater than or equal to reference time t2 (step S32), the capping controller causes the head to be transported to the capping position, and the cap is then driven to cap the nozzles (step S34). After the nozzles are capped, time interval time TI counting is interrupted (step S36), and the control process waits for the next print command (step S38).

If the print command is issued (step S38) after the nozzles are capped, the cap is removed from the ink jet head, a particular number of ink purging operations (10 in this example) is accomplished ejecting toward the cap (step S26), and the printing process is then executed (step S30).

While the present embodiment is applied to an ink jet printer comprising a cap for covering the nozzles, frequent capping of the nozzles can result in reduced throughput (printing speed). The above control method of the present invention that caps the nozzles after a predetermined ink jet head rest (no-ejection) time is more efficient than capping the nozzles after each line.

Furthermore, the increase in viscosity at the nozzle tip caused by sudden temporary coagulation of the surfactant as described above cannot be prevented by capping the nozzles, and until the second time reference value is reached capping the nozzles is not useful. In other words, it is more efficient during this time to maintain the ink jet head in a print-ready state rather than moving the ink jet head to the capping position, and maintaining this print-ready state can improve the actual printing speed (throughput).

Determining whether it is time to cap the ink jet head by referring to this second time reference value is thus extremely effective. The ink viscosity rise and ink solidification are also significantly delayed by capping the ink jet head, and capping can thus be used to reduce the number of ink purging operations required when compared with not capping the ink jet head.

It should be noted that in the above example ten ink purging operations are uniformly executed when the print command is issued after capping the ink jet head and interrupting the interval time count. It is also possible, however, to count the time interval the ink jet head is capped and then once the print command is received determine the number of required ink purging operations based on the elapsed time interval.

It is possible, for example, to execute 10 ink purging operations if this capped state continues for less than 5 hours, 20 ink purging operations if the capped state continues for between 5 and 10 hours, and 30 ink purging operations if the capped state continues for more than 10 hours. This control method is suited to facsimile machines and similar devices that may be left for extended periods of time with the power on. The present invention performs a waste-free nozzle refreshing process giving consideration to changes in the ink at the nozzle tip over longer periods of time.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An ink jet printer comprising plural nozzles for ejecting ink droplets, and means for executing an ink purging operation to prevent nozzle clogging when a no-ejection state continues for a predetermined time comprising:

a timer that measures a time interval between a last time ink was ejected from said nozzles and a present ink ejecting operation;

a storage device that stores at least two time reference values, a first time reference value and a second time reference value that is longer than said first time reference value; and a nozzle refreshing means for comparing said time interval measured by said timer with said first and second time reference values before printing, and for executing an ink purging operation a first number of times that is greater than or equal to zero when said measured time interval is less than said first time reference value, or a second number of times when said measured time interval is between said first time reference value and the second time reference value, or a third number of times that is less than the second number of times when said measured time interval is greater than said second time reference value.

2. The ink jet printer according to claim 1, wherein said timer starts measurement of said time interval from a previous ink purging operation, and further comprising:

a counter that counts ejections for each nozzle during printing, resetting means for resetting said timer in response to said counter, and wherein said resetting means resets the time interval measurement of said timer and restarts said timer measuring the time interval when, for every nozzle, the value counted by said counter has reached a preset count.

3. The ink jet printer according to claim 1, wherein said third number of times is less than or equal to one-half said second number of times.

4. The ink jet printer according to claim 1, wherein said storage device stores in addition to said first and second time reference values a third time reference value that is longer than said second time reference value, and said nozzle refreshing means executes an ink purging operation a third number of times when said measured time interval is greater than or equal to said third time reference value.

5. The ink jet printer according to claim 1, further comprising a capping controller for covering said nozzles with a cap when said measured time interval is greater than or equal to said second time reference value.

6. A control method for an ink jet printer comprising plural nozzles for ejecting ink droplets, and means for executing an ink purging operation to prevent nozzle clogging when a no-ejection state continues for a particular time, comprising the steps of:

measuring a time interval between a last time ink was ejected from said nozzles and a present ink ejecting operation;

comparing said measured time interval with at least two time reference values, a first time reference value and a second time reference value that is longer than said first time reference value, before printing; and, executing an ink purging operation a first number of times that is greater than or equal to zero when said measured time interval is less than said first time reference value, or a second number of times when said measured time interval is between said first time reference value and said second time reference value, or a third number of times that is less than said second number of times when said measured time interval is greater than said second time reference value.

7. The ink jet printer control method according to claim 6, further comprising the step of capping said nozzles when said measured time interval is greater than or equal to said second time reference value.

8. The ink jet printer control method according to claim 7, further comprising the step of interrupting the measurement of said time interval when said nozzles are capped.

9. The ink jet printer control method according to claim 6, wherein said measuring a time interval step comprises:

counting ejections for each nozzle during printing, continuing to measure said time interval during printing if even one of said plural nozzles does not eject for a preset count or greater, and resetting the time interval measurement and restarting measuring the time interval when the ejecting count of every nozzle has reached said preset count.

* * * * *